United States Patent [19]

Gmür

[11] Patent Number: 4,619,857

[45] Date of Patent: Oct. 28, 1986

[54] THIN WALLED SHAPED BODY AND METHOD OF PRODUCING SAME

[75] Inventor: Peter Gmür, Schwerzenbach, Switzerland

[73] Assignee: Amrotex AG, Glarus, Switzerland

[21] Appl. No.: 602,418

[22] Filed: Apr. 20, 1984

[30] Foreign Application Priority Data

Apr. 21, 1983 [CH] Switzerland ..... 2163/83

[51] Int. Cl.[4] ..... B32B 3/28

[52] U.S. Cl. ..... 428/186; 156/60; 428/182; 428/195; 428/198; 428/251; 428/253; 428/343; 428/703

[58] Field of Search ..... 428/703, 253, 254, 186, 428/182, 195, 198, 251, 343; 52/309.12; 156/149, 205, 108, 60; 264/228

[56] References Cited

U.S. PATENT DOCUMENTS

| | | | |
|---|---|---|---|
| 1,439,954 | 12/1922 | Emerson | 428/255 |
| 1,931,494 | 10/1933 | Hurden et al. | 428/182 |
| 2,728,698 | 12/1955 | Rudner | 428/256 |
| 4,159,361 | 6/1979 | Schupack | 428/251 |
| 4,265,961 | 5/1981 | Bena | 156/148 |
| 4,351,867 | 9/1982 | Mulvey et al. | 428/703 |
| 4,495,235 | 1/1985 | Tesch | 428/703 |

FOREIGN PATENT DOCUMENTS

| | | | |
|---|---|---|---|
| 1058396 | 2/1967 | United Kingdom | 428/256 |

*Primary Examiner*—James J. Bell

*Attorney, Agent, or Firm*—Michael J. Striker

[57] ABSTRACT

Thin walled shaped bodies, specifically profiled building elements, which bodies are made of a hydraulically set material, comprise at the outer surface thereof a preferably strip shaped reinforcement at least at the area of the highest tensile load, e.g. at the wave trough of a corrugated board, which reinforcement is bodily and materially bonded to the shaped body. Such shaped bodies have a greatly improved strength for high loadings, such as e.g. in an application for building elements forming covering or roofing members.

26 Claims, 1 Drawing Figure

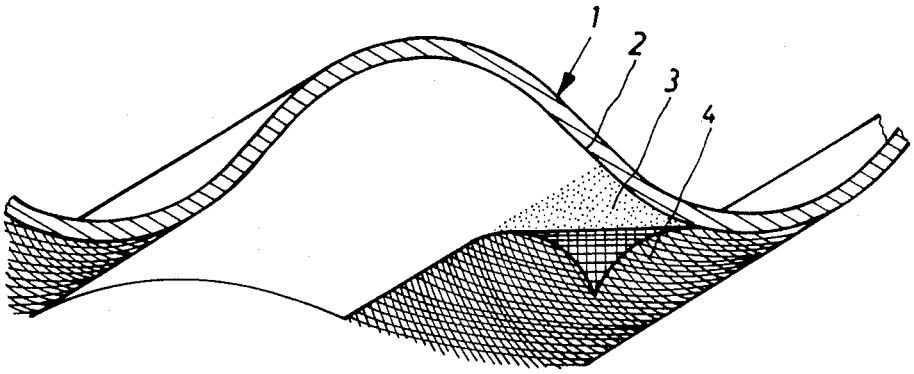
1
2
3
4

THIN WALLED SHAPED BODY AND METHOD OF PRODUCING SAME

BACKGROUND OF THE INVENTION

1. Field of the Invention

The present invention relates to thin walled shaped bodies made of a hydraulically set material, specifically to profiled structural elements. Hydraulically set materials are brittle and feature accordingly a high crushing strength but an extremely low tensile strength and an extremely low bending strength. For this reason thin walled structural elements such as flat and corrugated boards as well as any shaped bodies, which are produced from hydraulically setting materials, such as e.g. cement, are reinforced by an admixing of fibrous materials with the object of increasing their physical properties, specifically their flexural tensile strength.

2. Description of the Prior Art

A fibrous material which has been preferred for decades and has been of excellent service encompassed asbestos fibres. Since, however, the sources of such natural material are continually more limited and since this material gives rise to health hazards, specifically if it is improperly processed or mechanically heavily worn, abraded, efforts have been made worldwide to find or develop replacement fibres for such fibre reinforced cementitious materials, such to replace the asbestos fibres.

All suggestions which hitherto were made did however not provide satisfactory results and, specifically, it has not been possible as yet to find fibres which can properly replace asbestos fibres and indeed secure the requisite long term safety against a rupture of thin walled structural building elements being supported at points having a rather large mutual distance. All hitherto suggested replacement fibres lead to insufficient specific material properties such that it was impossible to meet the minimal safety against fracture prescribed by safety regulations. Accordingly, due to safety considerations even the most promising replacement fibres which are available up to this date can be utilized only by incurring large expenditures regarding the substructure or roofing, such as shortened mutual distances of supporting points, which solution is obviously not acceptable due to economic considerations.

Upon the first appearance of regulations limiting the use of asbestos fibres in civil engineering structures, such as e.g. put forth in Sweden, efforts were made initially to mix asbestos fibres with other natural or synthetic fibres. Mainly due to processing reasons specific mixtures were suggested, which consist of filter fibres and reinforcing fibres as well as an improvement of their bonding properties relative to the hydraulically setting materials by means of chemically pretreating such fibres. Moreover, new fibres were developed which met the demands regarding the reinforcing of cement better than the fibres which were available up to that date. Such new products are e.g. polyacryl-nitrite fibres, such as e.g. "DOLAN 10" (trademark of Hoechst AG, Federal Republic of Germany) as well as PVA-fibres "KURALON" (trademark of the Kuraray Co., Japan) etc. However, none of these fibres were able to secure the strength properties of plates and sheets made from asbestos cement. It is possible that cracks will develop in case of critical applications, e.g. increased local loads on products having large dimensions. Although the new fibres may be successively applied in shaped articles subjected to minor or limited loading forces, they have not been able to lend themselves as yet for an economic application for structural elements such as required e.g. for roof coverings of building structures having large spans, i.e. large distances between individual support areas such as in the range of >0.6 meters.

A common advantage of above mentioned replacement fibres is that they can be processed to hydraulically set building materials in a manner similar to the processing of asbestos in sifting drum machines (e.g. Hatschek-machines), which procedure corresponds to the most widely spread industrial practice. A significant feature of mentioned procedure is an even distribution of the reinforcing fibres within the complete mass. A further feature, however, is the impossibility of arbitrarily increasing the relative amount of the fibres such that regarding the reinforcing effect upper limits prevail.

Further suggestions related to the replacing of asbestos fibres are disclosed e.g. in the European Patent Application No. 0 013 305, according to which fibrillated plastic foils are arranged in a crisscross fashion within the cement matrix. Furthermore, an application of fibrillated film net structures has been suggested (GB-PS No. 1 582 945) as well as the use of embedded steel nets or steel bars as well as any kind of fibres, all such suggestions intended to increase the strength of the building materials. Glass fibres in the form of staple fibres or fibre nets have also been proposed in connection with the suggested fibres. The glass fibres are, however, not sufficiently alkaliproof, such that due to their chemical decomposition it is not possible to secure a long term strength of such glass fibre reinforced structures.

All experiments with reinforcing elements made up to now, which reinforcing elements were not evenly distributed with the cement but rather embedded in the mass, such as nets, bars, etc., made of plastic materials or metal, etc., lead to areas of weakness, which areas favored the forming of cracks, especially supported by the notch effects, and, therefore, led to preprogrammed rupture areas. A significant feature of all hitherto suggested solutions is their low wet strength (tested in accordance with ISO R 393) in comparison with their dry strength (tested in accordance with DIN 274), which is detrimental with regard to their use.

SUMMARY OF THE INVENTION

Hence, it is a general object of the invention to provide a thin walled shaped article having improved strength properties.

A further object of the invention is to provide a thin walled shaped article made of compound materials which are bound by hydraulically set materials and incorporating an highly improved tensile strength by comprising at least a reinforcement located at the surface of such area in which in the critical case has the highest exposure to tension forces.

Yet a further object of the invention is to provide a thin walled shaped article made of a compound material bound by hydraulically set materials having an outer reinforcing material applied onto the finished article and without reinforcing elements imbedded therein.

Still a further object of the invention is to provide a thin walled shaped article made of a compound material bound by hydraulically set materials, specifically a profiled building element which is bodily bonded to a reinforcing material at least at the areas subjected to the highest critical tensile stress.

The invention is of a specific interest with regard to profiled articles such as corrugated boards and other profiled building elements such as e.g. used for roofings in such cases in which a high bending stress and/or a high tensile stress will be encountered. This is applicable e.g. if high local loads must be coped with such as when the roofing is walked upon, allows, however, also an increase of the distance between supporting points within, obviously, the allowable general loading capability thereof. The present invention finds applicability as well in case of flat boards.

The material of the shaped articles which will be referred to as "base material" throughout the specification may consist of not reinforced cement mortar and other cementitiously bound construction materials. Preferably, the base material contains a fibre reinforcement of organic and/or inorganic fibres and/or fibre-like materials, such as e.g. fibrides, specifically cellulose, various kinds of cement and various kinds of fibres which can be utilized for such tasks and which are generally known to the person skilled in the art.

Any kind of natural, semi-synthetic and synthetic materials may be used as reinforcing material. Apart from the tensile strength and the elongation of rupture it is the modulus of elasticity which mainly determines the behavior and effect of the reinforcing material. If an increase of the breaking strength is called for, the modulus of elasticity of the reinforcing material must be higher than such of the base material. If merely a so-called after breaking strength is called for, such as e.g. to reduce the risk of an accident, the modulus of elasticity of the reinforcing material may be lower than such of the base material. A combination of a variety of reinforcing materials having differing moduli of elasticity can be applied, too. Such reinforcing material may be e.g. woven materials, embedded materials, knitted materials, nets, non-woven materials, threads, yarns, fibre strands, fibre bands etc. as well as sheets, plates, foils, emulsions, wires, gratings etc. of glass, plastic materials, elastomeric material, metals, ceramic materials, etc.

In case of a corrugated board the bottom surfaces of the wave troughs are the areas subjected to the highest forces and, accordingly, the reinforcement extends preferably in the direction of the wave trough and at its lower side in form of an uninterrupted strip having a width which is determined by the cross section and tensile strength of the reinforcing material as well as the particulars of the base material and also by the extent of the reinforcement being sought.

The reinforcing strip can be mounted at the surface which has the highest exposure to tension forces and to one or several wave troughs and/or wave crests at the same side of the plate. Specific applications can foresee an additional mounting of reinforcements to areas subjected to compressive forces.

In case of flat plates, specifically flat plates of large dimensions, the reinforcement can be evenly distributed over the complete surface; it can, however, also be applied in form of laterally and/or longitudinally extending strips or of diagonally extending strips extending at predetermined distances from each other.

Generally, the reinforcing material is physically bonded to the base material by means of a suitable, cement resistant high strength bonding agent. Suitable bonding agents are e.g. such which are based on commercially available reaction resins, such as e.g. epoxy resins, unsaturated polyester resins, vinyl-ester resins, polyurethanes, etc.

Suitable plastic materials, e.g. cement resistant plastic materials can possibly also be directly melted onto the base material or applied in a solvent.

The reinforcing material may also be provided with an additional surface layer such to protect the material against corrosion, etc. Such surface layer can be at the same time the bonding agent and penetrate the reinforcing strip completely.

The inventive reinforced shaped articles have a substantially increased breaking strength. The breaking strengths, for instance, tested in a dry state in accordance with DIN 274 can be more than doubled by a strip-wise reinforcement of the wave troughs of corrugated plates of fibrous cement extending laterally, and if extending parallel to the waves by more than 50 percent. In a strong contrast to all experiences made with products consisting of fibrous cement, inclusive asbestos cement, it has been proven at a corrugated board which was reinforced in accordance with the invention, that the wet breaking load, which is the most important feature for practical applications, measured laterally relative to the wave and tested in accordance with ISO R 393 amounts to significantly higher values than the dry test, namely, averaging additional 40%. Also the deviation of quality, in terms of the variation coefficient of the breaking load, is substantially reduced. The stacking features and the stacking volume are maintained.

By means of the inventive reinforcement, even the breaking load of corrugated asbestos cement boards is improved. If the shaped articles are used for minor loadings, the invention allows significant savings in that the thickness of the products can be reduced.

BRIEF DESCRIPTION OF THE DRAWINGS

The invention will be better understood and objects other than those set forth above will become apparent when consideration is given to the following detailed description thereof. Such description makes reference to the annexed drawing in which the single FIGURE illustrates a perspective view of a reinforced shaped article in accordance with the invention.

DETAILED DESCRIPTION OF PREFERRED EMBODIMENT

The corrugated board 1 made of a fibrous cement is provided on the inwards facing surface 2 of the wave trough with a layer 3 of an adhesive and a web 4 of woven glass fibres. The following improvements were reached therewith:

TABLE 1

| | | Test at air dry conditions | | |
|---|---|---|---|---|
| Example | Parameter of quality | O-test | With reinforcement | Improvement reached |
| 1 | Breaking load laterally of wave | 377 kp | 805 kp | 113% |
| | Breaking load longitudinally of wave | 53.7 kp | 70.9 kp | 32% |
| 2 | Breaking load laterally of wave | 373 kp | 786 kp | 110% |
| | Breaking load longitudinally of wave | 51.7 kp | 75.6 kp | 46% |
| 3 | Breaking load laterally of | 509 kp | 816 kp | 60% |

TABLE 1-continued

| Example | Parameter of quality | Test at air dry conditions O-test | With reinforcement | Improvement reached |
|---|---|---|---|---|
| | wave | | | |
| | Breaking load longitudinally of wave | 41 kp | 76 kp | 85% |

TABLE 2

| Example | Parameter of quality | Test after 48 hours deposited in water O-test | With reinforcement | Improvement reached |
|---|---|---|---|---|
| 1 | Breaking load laterally of wave | 414 kp | 1060 kp | 156% |
| | Breaking load longitudinally of wave | 36.8 kp | 51.6 kp | 40.2% |
| 2 | Breaking load laterally of wave | 391 kp | 990 kp | 153% |
| | Breaking load longitudinally of wave | 35.2 kp | 53.3 kp | 51.4% |
| 3 | Breaking load laterally of wave | 482 kp | 1023 kp | 122% |
| | Breaking load longitudinally of wave | 39 kp | 69 kp | 76% |

In the Examples 1 and 2 asbestosless corrugated boards were used, the dimensions of which conforming to SIA-Standard 175 including about 2 weight percent "DOLAN-10"-fibres (of Hoechst AG) and cement. The plates, furthermore, contain organic filter fibres. Example 3 is a corrugated board made of asbestos cement conforming to SIA-Standard 175. The plates of the three executions were bodily connected at the respective lower areas of the wave troughs by a web of woven glass fibres of a width of 7.5 centimeters, weaving particulars: warp 7.2 threads/centimeter, tex 2×136; weft 5×1 threads/centimeter, tex 3×136; breaking strength about 36 kg/centimeters, the connection made by means of the epoxy-adhesive "GRILONIT" (of the EMS Chemical Co.).

The applying of the reinforcing elements of the above examples were made to previously shaped and set corrugated boards and the procedure was as follows:

The woven glass fibre strips provided in form of rolls are wound off by means of a feeding mechanism and led through a dosing means, in which it simultaneously is positively saturated or impregnated, respectively, by the bonding agent, i.e. the adhesive agent. Therefter, the reinforcing strips, pretreated as set forth above, are placed with the aid of suitable gripping means onto the beginning of the wave troughs of the corrugated boards located directly under the impregnating station. Thereafter, the board is set into motion such that it moves in the same direction in which the strips are wound off and moves synchronously therewith. By means of rotating pressure rollers the strips are pressed against and thus physically bonded to the board. A cutting apparatus cuts to so to speak endless reinforcing strips after the prerequisite length has been arrived at. The accordingly treated boards are stacked. The setting of the resin at ambient temperature, at above conditions, will take place within about 24 hours.

The invention is not confined to above mentioned embodiments. Similar continuously or discontinuously operating methods of applying and mounting of the reinforcement and base plate is securely arrived at.

While there are shown and described present preferred embodiments of the invention, it is to be distinctly understood that the invention is not limited thereto, but may be otherwise variously embodied and practiced within the scope of the following claims.

I claim:

1. A thin walled asbestos fibre-free shaped article, comprising: a body of a hydraulically set material, said body having a first outside surface with areas subjectable to a highest critical tensile load; a layer of bonding material; and a reinforcing material applied directly on and bonded to said first outside surface by said bonding material at least at said highest critical tensile load areas without mutual penetration of said hydraulically set material of said body and said reinforcing material.

2. The thin walled shaped article of claim 1, wherein said body is formed with a second outside surface with areas subjectable to a compressive load; and further comprising a reinforcing material applied directly on and bonded to said areas subjectable to said compressive load.

3. The thin walled shaped article of claim 1, wherein said reinforcing material is applied in a strip shaped fashion.

4. The thin walled shaped article of claim 1, wherein said body is formed as a corrugated board having longitudinal corrugations, each said corrugation defining a trough and a crest, and said reinforcing material is applied in a form of continuous or discontinuous strips extending in the longitudinal direction of said corrugations at least at said outside surface which is subjected mainly to tensile loads and on at least one trough and one crest and at the same side of said board.

5. The thin walled shaped article of claim 1, wherein said hydraulically set material is a cementitiously bound building material.

6. The thin walled shaped article of claim 5, wherein said cementitiously bound building material consists of organic and inorganic fibres.

7. The thin walled shaped article of claim 1, wherein said reinforcing material is selected from the group consisting of woven organic fabric, knitted organic fabric, woven inorganic fabric and knitted inorganic fabric.

8. The thin walled shaped article of claim 1, wherein said reinforcing material is selected from the group consisting of nonwoven organic felting, nonwoven inorganic felting, an organic net, an inorganic net, an organic plaited work, an inorganic plaited work, endless organic threads, endless organic fibers, endless organic strands of threads, endless inorganic threads, endless inorganic fibers, and endless inorganic strands of threads.

9. The thin walled shaped article of claim 1, wherein said reinforcing material is selected from the group consisting of metal, plastic material, elastomers, paper, glass and ceramics.

10. The thin walled shaped article of claim 9, wherein said reinforcing material is selected from the group consisting of striplike sheets, plates, foils, grids, wires, fibrillated foils, prestretched foils and fibrillated, prestretched foils.

11. The thin walled shaped article of claim 1, wherein said reinforcing material is present in form of a fibre-reinforced plastic material.

12. The thin walled shaped article of claim 1, wherein said reinforcing material and said body material each have a modulus of elasticity, the modules of elasticity of the reinforcing material has a higher value than the modules of elasticity of the body material.

13. The thin walled shaped article of claim 1, wherein said reinforcing material and said body material each have a modulus of elasticity, the modulus of elasticity of the reinforcing material has a lower value than the modulus of elasticity of the body material.

14. The thin walled shaped article of claim 1, wherein said reinforcing material comprises a combination of materials, said combination having some materials having a higher modulus of elasticity, and other materials having a lower modulus of elasticity than such of the body material.

15. The thin walled shaped article of claim 1, wherein the reinforcing material is bonded to the body material by means of an adhesive agent.

16. The thin walled shaped article of claim 15, wherein said reinforcing material consists of strips of a glass fibre weaving, and said adhesive agent is an epoxy resin.

17. The thin walled shaped article of claim 15 wherein the reinforcing material is provided with a protective coating.

18. The thin walled shaped article of claim 17, wherein said protective coating is formed by said adhesive agent itself.

19. The thin walled shaped article of claim 16, wherein the reinforcing material is provided with a protective coating.

20. The thin walled shaped article of claim 19, in which said protective coating is formed by said adhesive agent itself.

21. A thin walled shaped article as defined in claim 4, wherein said strips are applied only on at least one trough.

22. A thin walled shaped article as defined in claim 4, wherein said strips are applied only on at least one crest.

23. A thin walled shaped article as defined in claim 5, wherein said cementitiously bound building material consists of organic fibers.

24. A thin walled shaped article as defined in claim 5, wherein said cementitiously bound building material consists of inorganic fibers.

25. A method for producing a thin walled asbestos fiber-free shaped article, comprising the steps of: providing a thin walled shaped body of hydraulically set material having a first outside surface with areas subjectable to a highest critical tensile load; setting said material of said body; applying a reinforcing material after setting on said outside surface at least at said highest critical tensile load areas; and bonding said reinforcing material to said outer surface of said body at least at said areas by a layer of bonding material without mutual penetration of said hydraulically set material of said body and said reinforcing material.

26. The method of claim 25, wherein said applying a reinforcing material step includes applying said reinforcing material onto said base body after setting of latter.

* * * * *